US006796430B2

(12) United States Patent
Mercier et al.

(10) Patent No.: US 6,796,430 B2
(45) Date of Patent: Sep. 28, 2004

(54) NESTING CONTAINERS AND LIDS

(76) Inventors: Doug Mercier, 3047 Idyllbrook La., Erie, PA (US) 16506; Richard E. Griffith, 5539 Peach St., Erie, PA (US) 16509

( * ) Notice: Subject to any disclaimer, the term of this patent is extended or adjusted under 35 U.S.C. 154(b) by 0 days.

(21) Appl. No.: 10/075,451

(22) Filed: Feb. 15, 2002

(65) Prior Publication Data

US 2003/0155267 A1 Aug. 21, 2003

(51) Int. Cl.[7] ..... B65D 21/00
(52) U.S. Cl. ..... 206/505; 220/212; 220/630
(58) Field of Search ..... 220/212, 23.86, 220/630, 379, 380, 23.88, 23.9, 662; 206/515, 505, 507, 508, 514

(56) References Cited

U.S. PATENT DOCUMENTS

| | | | | |
|---|---|---|---|---|
| 2,412,325 A | * | 12/1946 | Devine et al. | 206/508 |
| 2,575,770 A | * | 11/1951 | Roop | 206/514 |
| 2,695,115 A | * | 11/1954 | Roop | 220/802 |
| 4,621,670 A | * | 11/1986 | Yuen | 220/801 |
| 4,733,790 A | * | 3/1988 | Stein | 220/23.83 |
| 4,892,213 A | * | 1/1990 | Mason, Jr. | 220/4.21 |
| 4,951,832 A | * | 8/1990 | Tenney et al. | 220/23.83 |
| 5,184,745 A | * | 2/1993 | Havens et al. | 220/23.83 |
| 5,356,026 A | * | 10/1994 | Andress et al. | 206/508 |
| 5,409,126 A | * | 4/1995 | DeMars | 220/4.27 |
| 5,423,453 A | * | 6/1995 | Fritz | 220/608 |
| 5,586,656 A | * | 12/1996 | Abrums | 206/501 |
| 5,769,229 A | * | 6/1998 | Andress et al. | 206/505 |
| 5,868,268 A | * | 2/1999 | Walker | 220/379 |

FOREIGN PATENT DOCUMENTS

| | | |
|---|---|---|
| DE | 1 811 773 | 6/1970 |
| EP | 0 717 950 A1 | 6/1996 |
| GB | 2 0942 273 | 9/1982 |
| GB | 2 121 673 | 1/1984 |

* cited by examiner

*Primary Examiner*—Stephen K. Cronin
*Assistant Examiner*—Joseph C. Merek
(74) *Attorney, Agent, or Firm*—Oliff & Berridge, PLC

(57) ABSTRACT

A container and lid combination includes a container having a bottom surface, an opening, a top edge surrounding the opening, and an attachment mechanism provided on the bottom surface, and a lid engageable with the top edge of the container to cover the opening. The lid may include an attachment mechanism provided on its inside surface that is engageable with the attachment mechanism of the bottom surface of the container. The lid is attachable to the bottom surface of the container in a nested state via engagement of the respective attachment mechanisms. Another attachment mechanism may be provided on the outside surface of the lid that is engageable with the attachment mechanism of the bottom surface of the container. The lid is attachable to the bottom surface of the container in a nested state and/or in an inverted state via engagement of the attachment mechanisms. A set of such container and lid combinations may be nested together. Furthermore, in a set of container and lid combinations, the base of the container of one container and lid combination may be attachable to the outside surface of the lid of another container and lid combination, to facilitate transporting of the container and lid combinations.

14 Claims, 6 Drawing Sheets

NESTING CONTAINERS AND LIDS

BACKGROUND OF THE INVENTION

1. Field of Invention

This invention relates to containers with lids.

2. Description of Related Art

Various types of lidded containers are known. Lidded containers are often sold in sets, and often each container of a set is of a different size such that the containers "nest" together, i.e., the smallest container fits inside the next-largest container, which in turn fits inside the next-largest container, and so on.

SUMMARY OF THE INVENTION

In such sets of containers, various problems are associated with management and storage of the lids. For example, the lids typically are stored separately from the containers, and often become lost. Additionally, when a particular lid is desired, the user must sort through the supply of lids to find the appropriate lid, which is troublesome.

This invention addresses these problems, and provides other advantages, by providing a container structure in which, when the container is not in use, the lid attaches to a bottom of the container.

In embodiments, the outside surface of the bottom of the container includes an attachment mechanism that attaches to a complementary attachment mechanism provided on an inside surface of the lid.

The outside surface of the lid may also include an attachment mechanism so that the lid may be attached to the container bottom in an inverted state. This inverted state of attachment is advantageous when, for example, the container and lid are placed together in a dishwasher for washing. The inverted state of attachment is also advantageous when, for example, multiple containers in an in-use state (e.g., a state of being filled with a food or other product) are stacked, one on top of another. In this state, the attachment mechanism of the bottom of the container on top may attach to the complementary attachment mechanism of the outside surface of the lid of the container below.

The attachment mechanisms may include a plurality of attachment projections. The attachment projections of the lid maybe angled toward the attachment portions of the container to provide a reliable engagement between the attachment projections of the lid and the attachment projections of the container.

These and other objects, advantages and salient features of the invention are described in or apparent from the following detailed description of exemplary embodiments.

BRIEF DESCRIPTION OF THE DRAWINGS

Exemplary embodiments of the invention will be described with reference to the following drawings, wherein like numerals represent like parts, and wherein.

DETAILED DESCRIPTION OF PREFERRED EMBODIMENTS

This invention provides container lids that attach to an outside surface of a container bottom.

Figure 1:
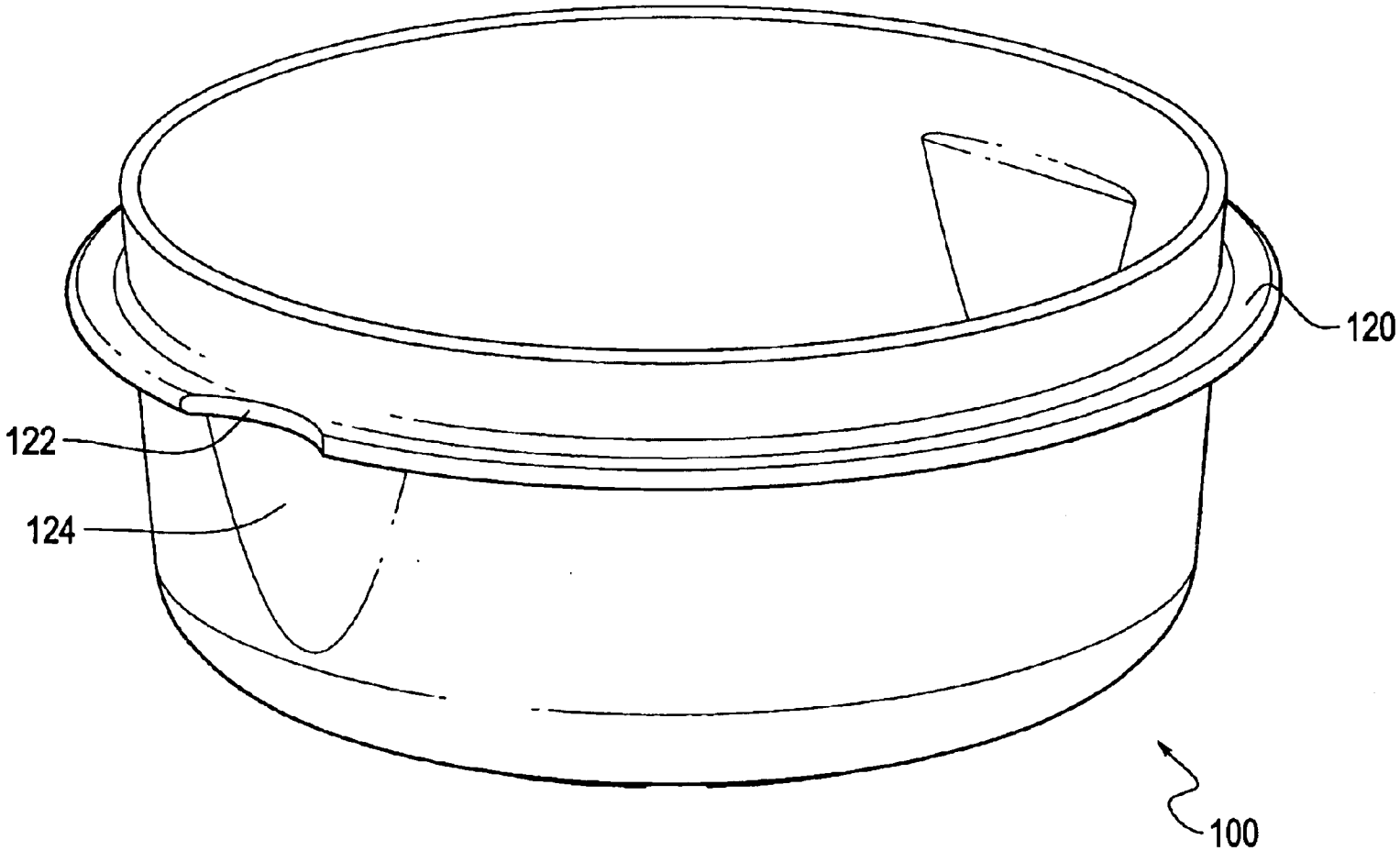
FIG. 1 is an oblique view of a first exemplary container according to the invention.

FIG. 1 shows a container 100. The container is shown having a round shape in plan view, but any other desired shape, such as rectangular, square, triangular, pentagonal, etc. is also acceptable. The container 100 will typically be formed of plastic material.

The container 100 may include a ridge 120 provided around the outer periphery near a top edge of the container 100. The ridge 120 reinforces the upper edge of the container 100 for greater strength and rigidity. The ridge 120 also facilitates closing of a lid, described below, onto the top edge of the container 100 by providing a structure for a user's fingers to anchor against while pressing the lid into sealing connection with the top edge of the container 100.

Several notches 122 are preferably provided in the ridge 120. The notches 122 allow the user's fingers easy access to the lid in order to remove the lid. The notches 122 also provide the advantage of allowing the outer circumference of the lid to be free of any protrusions such as are often present on prior art lids to provide a gripping ledge for a user's fingers. This facilitates nesting of the lids inside other containers, as described in more detail below.

The container 100 may also include one or more windows 124. In the embodiment shown in FIG. 1, the windows 124 are formed as concave surfaces in the wall of the container 100. However, any other desired configuration of the windows 124, such as flat, convex, etc., is also acceptable. When the container 100 is formed of molded clear plastic, the transparency of the plastic may be reduced by slightly roughening the surfaces of the mold. The windows 124 may be made by, for example, polishing or grinding the corresponding portions of the mold very smooth relative to surrounding portions so that the resulting portions of the container 100 corresponding to the windows 124 are correspondingly smooth. This results in greater transparency at the windows 124 relative to the other portions of the container 100. Therefore, the contents of the container 100 may be viewed without removing the lid.

Figure 2:
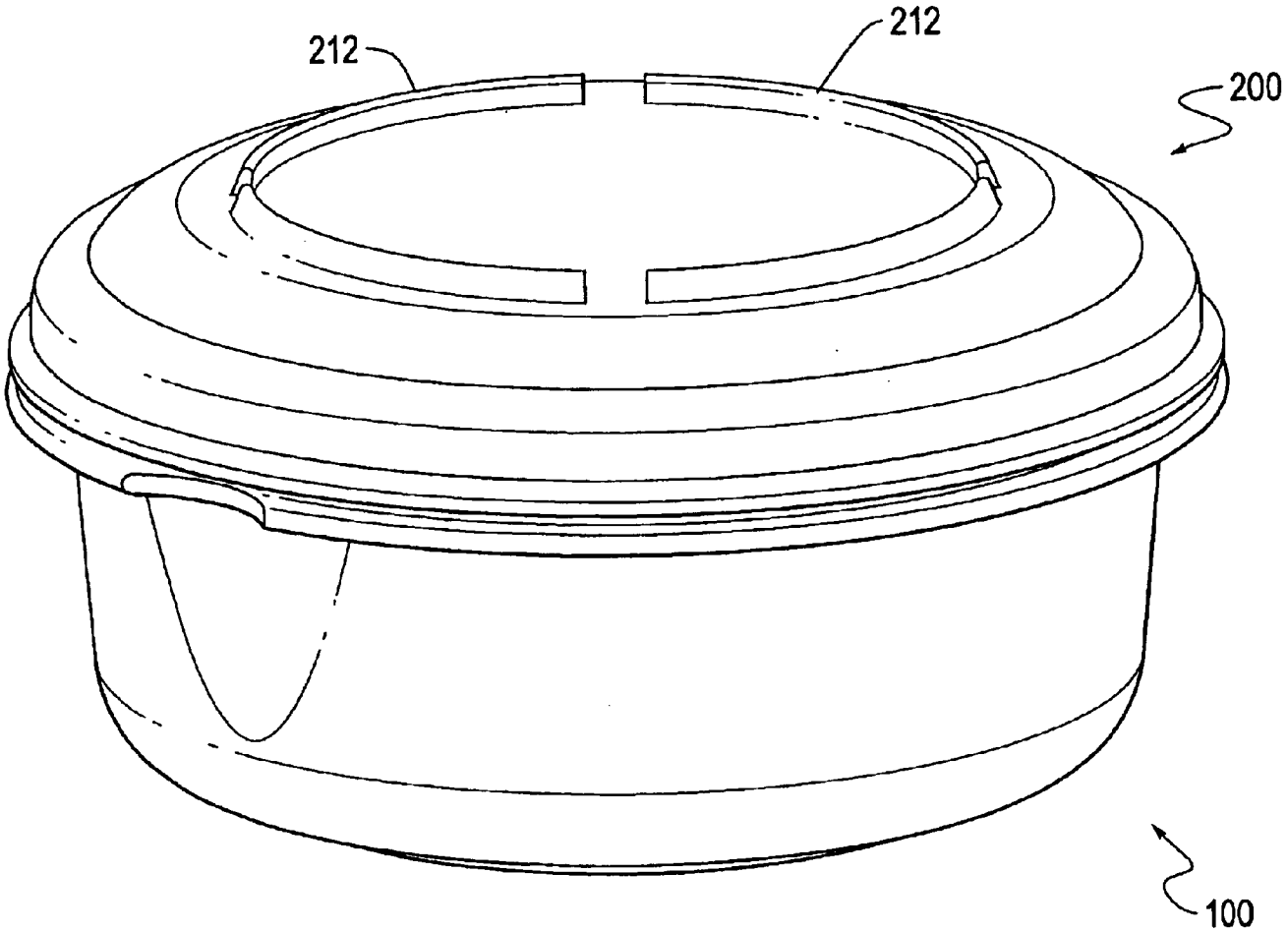
FIG. 2 is an oblique view of the container of FIG. 1 with a lid attached to the top thereof.

As shown in FIG. 2, a lid 200 is provided that is sized and shaped such that its inner periphery engages the outer periphery of the top edge of the container 100 to effect a sealing relationship between the container 100 and the lid 200. The inside surface of the lid 200 includes an attachment mechanism, described in more detail below, that engages a corresponding attachment mechanism provided on a bottom surface of the container 100, also described in more detail below. The outside surface of the lid 200 may also include an attachment mechanism that engages the engagement mechanism on the bottom surface of the container 100. In FIG. 2, the attachment mechanism on the outside surface of the lid 200 includes four attachment projections 212. The attachment projections 212 are arcuate in shape, and together approximately define a circle.

Figure 3:
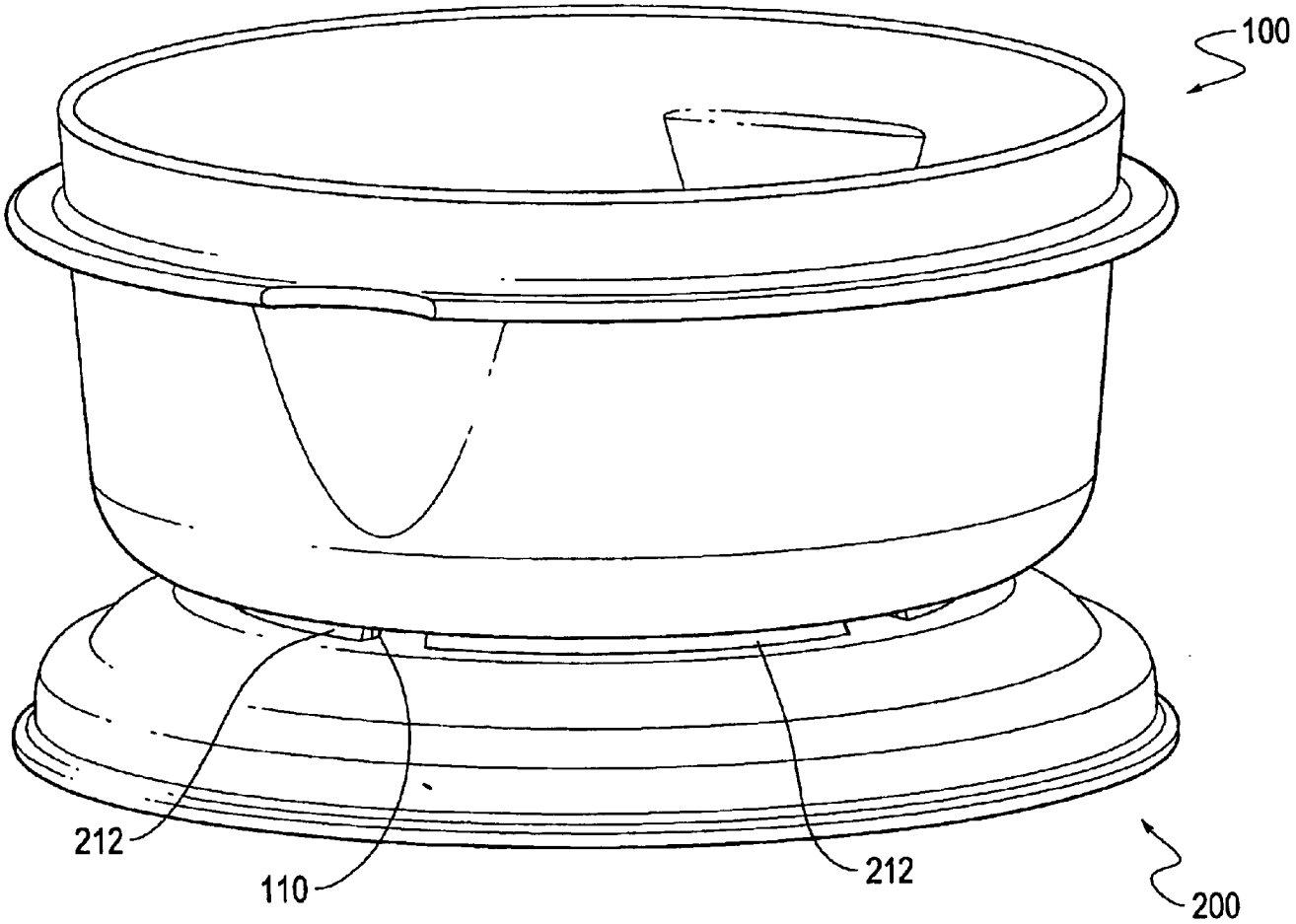
FIG. 3 is an oblique view of the container of FIG. 1 with the lid attached to the bottom surface thereof in an inverted state.

As shown in FIG. 3, the attachment mechanism provided on the bottom surface of the container 100 includes a plurality of attachment projections 110. The attachment projections 110 correspond in shape to the attachment projections 212 on the outside surface of the lid 200. The attachment projections 212 frictionally engage the attachment projections 110 so that the lid 200 may be retained on the bottom of the container 100 in an inverted state.

Advantages of allowing the lid 200 to attach to the container 100 in an inverted state as shown in FIG. 3 include (1) the fact that, when placed in a dishwasher to be washed, the interior surfaces of both the container 100 and the lid 200 face outward and thus are better subjected to the cleaning action of the dishwasher; (2) the fact that, when a plurality of containers 100 and lids 200 are used, each being filled with a food or other product, the lid 100 of one container 200 may engage with the bottom surface of another container, thus locking the containers 100 and lids 200 together in a stacked relationship for easier carrying or the like; and (3) the fact that a container 100, particularly a small container 100, may be locked to its own lid 200 or the lid 200 of a larger container 100 in an inverted relationship for greater stability while being used as, for example, a serving dish.

Figure 4:
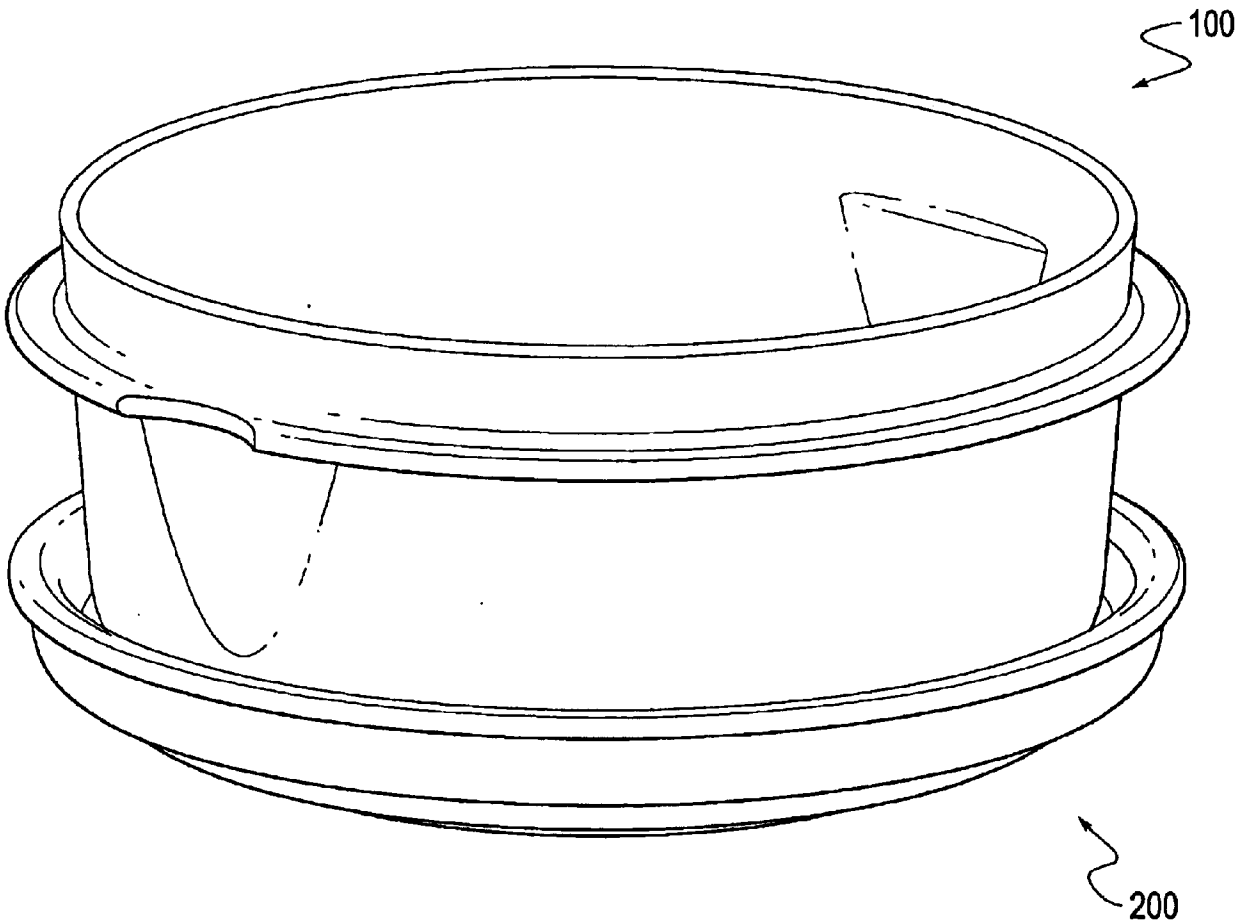
FIG. 4 is an oblique view of the container of FIG. 1 with the lid attached to the bottom surface thereof in a nested state.

As shown in FIG. 4, the lid 200 also is attachable to the bottom surface of the container 100 in a non-inverted state, hereafter called a nesting state. Specifically, as shown in FIG. 5, which shows a cross section of a second exemplary embodiment, attachment projections 210 are provided on an inside surface of the lid 200 and frictionally engage the attachment projections 110 provided on the bottom surface of the container 100.

Figure 5:
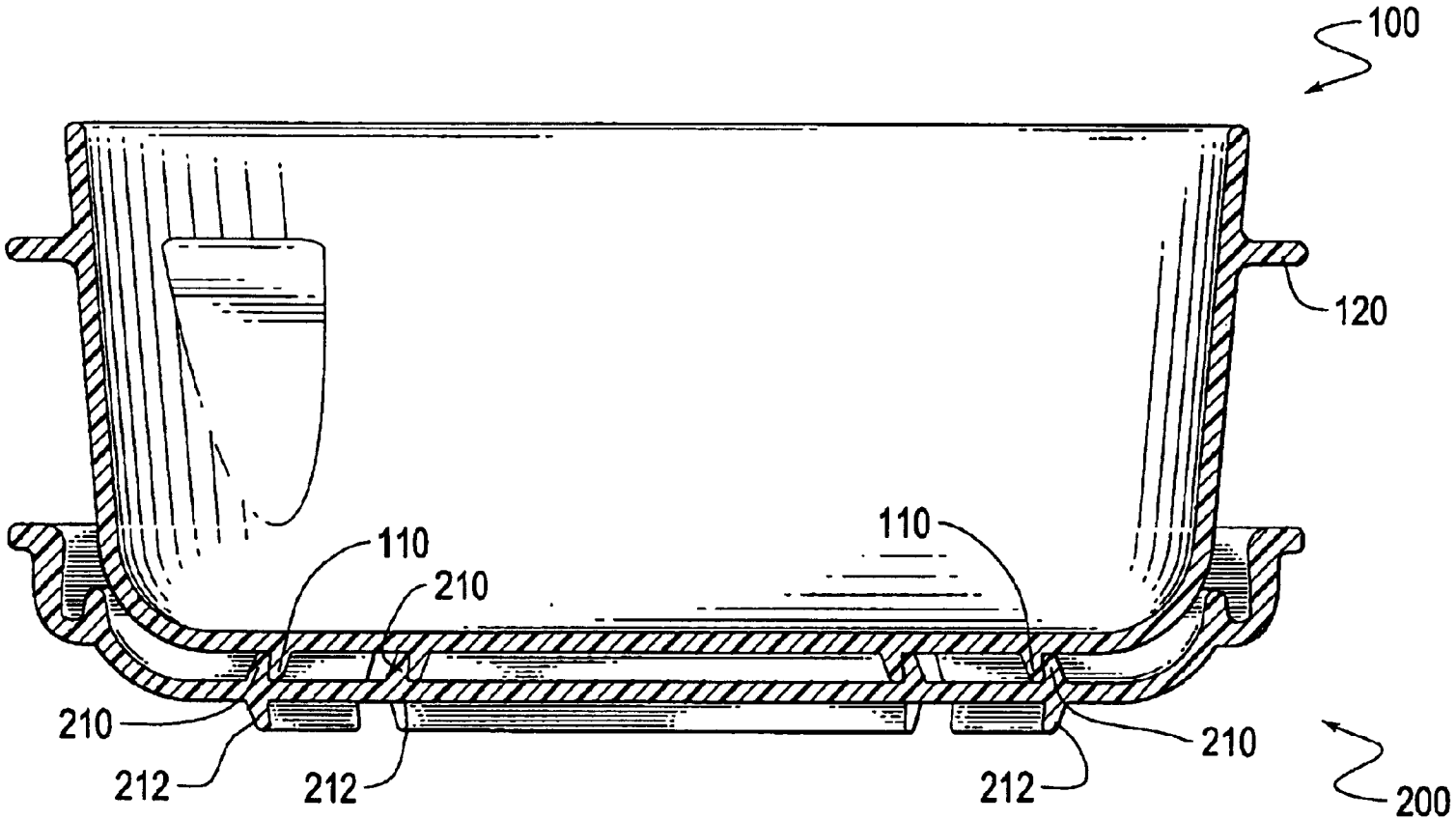
FIG. 5 shows a cross section of a second exemplary container according to the invention with a lid attached to the bottom surface thereof in a nested state.

In the embodiment shown in FIG. 5, rather than a single set of each of the attachment projections 110, 210 and 212, two sets of each are provided, respectively approximately defining concentric circles. While the extra sets of the attachment projections 110, 210 and 212 are not essential, they may provide advantages such as more secure attachment of the lid 100 to the container 100. A further advantage of the second set of attachment projections 212, in particular, is that the base of a small container may be attached to the lid of a large container, as described in more detail below.

As shown in FIG. 5, the attachment projections 110 on the base of the container 100 angle outward from the base of the container 100 away from the center of the container 100, and the attachment projections 210 and 212 on the lid 200 angle inward from a top surface of the lid 200 toward the center of the lid 200. This configuration allows more secure attachment of the lid 200 to the container 100.

In FIG. 5, it can be seen that inward-facing sides of the attachment projections 210 and 212 of the lid 200 engage outward-facing sides of the attachment projections 110 of the base of the container 100. In contrast, in FIG. 3, outward-facing sides of the attachment projections 212 are shown as engaging the inward-facing sides of the attachment projections 110. It should be appreciated that either arrangement is acceptable. However, it will also be appreciated that, when the attachment projections 110, 210 and 212 are angled as shown in FIG. 5 and described above, the direction of the angle should be reversed if the outward-facing sides of the attachment projections 210 and/or 212 are to engage the inward-facing sides of the attachment projections 110.

It should also be appreciated that, while the attachment projections 110, 210 and 212 have been described above as having an arcuate shape and approximately defining circles, many other shapes and configurations are possible. For example, the attachment projections 110, 210 and 212 may have a linear shape, with the attachment projections 110 on the bottom of the container 100 approximately defining a square, triangle, pentagon, hexagon, octagon or the like, and the attachment projections 210 and 212 on the lid 200 approximately defining corresponding squares, triangles, pentagons, hexagons, octagons or the like.

Additionally, although the attachment mechanisms described above have each included a plurality of attachment projections 110, 210 or 212, it should be appreciated that each attachment mechanism alternatively may have only a single attachment projection, e.g., a continuous annular projection or the like. However, it is usually preferable for the attachment mechanism to include more than one attachment projection, for the following reasons.

First, if a single attachment projection is provided in the form of a continuous circle or the like, a "pool" will be formed by the attachment projection when the container 100 or lid 200 is, for example, placed upside down in a dishwasher. Water will collect in this "pool" during washing, which is annoying to a user who subsequently removes the container 100 or lid 200 from the dishwasher. In contrast, when a plurality of attachment projections are formed, as illustrated in the embodiments described above, a notch is formed between adjacent ones of the attachment projections 110, 210 or 212. The notches allow water to escape, thus preventing ponding during washing.

Second, having a plurality of attachment projections 110, 210 or 212 allows the projections to deflect more resiliently and thus more easily engage opposing attachment projections 110, 210 or 212.

Figure 6:
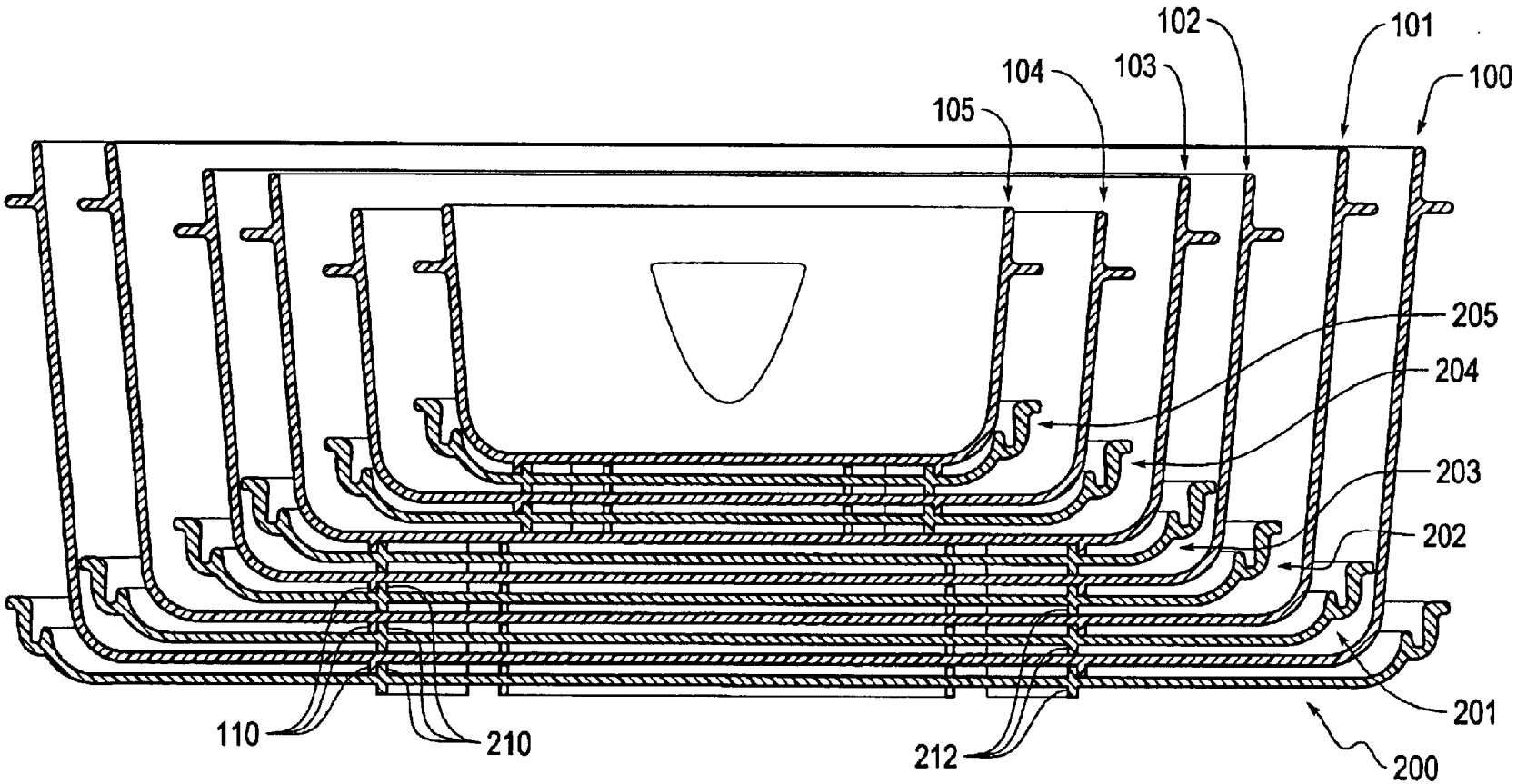
FIG. 6 shows a cross section of a plurality of containers and lids according to the invention, in a nested state.

FIG. 6 shows a cross section of a plurality of containers 100–105 nested together. Each container 100–105 has a corresponding lid 200, 201, 202, 203, 204 or 205 attached to its base in a nesting state by engagement of the attachment projections 110 with the attachment projections 210. To enable connection between the base of one of the containers 200–205 and the lid 200, 201, 202, 203, 204 or 205 of one or more of the other containers 200–205, the containers 100–105 and lids 200–205 have, insofar as is practical, the same configuration of the attachment projections 110, 210 or 212. For example, as shown in FIG. 6, the attachment projections 110 of container 100 are identical in shape and position to the attachment projections 110 of containers 101, 102 and 103, and the attachment projections 110 of container 105 are identical in shape and position to the attachment projections 110 of container 106.

There are practical limits to making the attachment projections of each container have the same position, for the following reason. As can be appreciated from the drawings, each container 100–105 rests on the attachment projections 110 when placed on a horizontal surface. If attachment projections 110 are spaced too closely together on the base of the container 100, 101, 102, 103, 104 or 105 relative to the width of the base of the container, the container may not be sufficiently stable. On the other hand, in the case of the smaller containers in a set, e.g., containers 105 and 106, the attachment projections 110 clearly cannot be spaced wider than the maximum width of the base of the container.

Accordingly, a suitable spacing width is selected for the attachment projections 110 on the largest container in a set, e.g., container 100, and this spacing is maintained for each successively smaller container until such a spacing would no longer practically fit on the base of the container. Thus, for example, in FIG. 6, the spacing of the attachment projections 110 on container 100 is maintained for containers 101–103, but would not fit on containers 104 and 105; therefore, a narrower spacing is used for containers 104 and 105. An example of a suitable width of the spacing of the attachment projections 110 of the largest container 200 is greater than or equal to about one half of the width of base of the largest container 200.

As shown in FIG. 6, the heights of the containers 100–105 are preferably selected such that, when the containers 100–105 are nested as shown, none of the top edges of containers 101–105 protrude above the plane of the top edge of container 100. This allows the lid 200 to be placed on the top of the container 100 with all of the other containers 101–105 stored inside the container 100.

In FIGS. 5 and 6, on each of the lids 100–105, the attachment projections 210 on the inside surface of the lid are located at positions exactly opposite the positions of the attachment projections 212 on the outside surface of the lid. However, it is also acceptable for the attachment projections 210 on the inside surface of the lid to not be located at positions exactly opposite the positions of the attachment projections 212 on the other side of the lid. For example, the attachment projections 212 on the outside surface of the lid may approximately define a circle smaller than the circle approximately defined by the attachment projections 210 on the inside surface of the lid, and thus not be located exactly opposite the attachment projections 210.

Considering the containers 100–105 in FIG. 6, it can be appreciated that, when the containers 100–105 are in use, with the lids 100–205 attached respectively to the top edges of the containers 100–105, the bottom surfaces of only containers 101–104 can attach to the outer surface of the lid 200, the bottom surfaces of only containers 100 and 102–104 can attach to the outer surface of the lid 201, etc. Similarly, the bottom surface of only container 106 can attach to the outer surface of the lid 205, and the bottom surface of only container 105 can attach to the outer surface of the lid 206. However, if more than one set of attachment projections 212 are provided on at least the larger ones of the lids, e.g., lids 200–204, as shown in FIG. 5, greater flexibility can result. Specifically, for example, if the lid 200 has two sets of attachments projections 212 as shown in FIG. 5, and if the inner set of attachment projections 212 match with the attachment projections 110 of the container 105 and/or 105, then the container 105 and/or 106 can also be attached to the lid 200.

Allowing the lids and containers to interchangeably interconnect as described above is particularly advantageous when, for example, multiple containers in an in-use state (e.g., a state of being filled with a food or other product) are stacked, one on top of another. In this state, the attachment mechanism of the bottom of the container on top may attach to the complementary attachment mechanism of the outside surface of the lid of the container below. For example, if the user is attending a party and taking chips in the container 100 and salsa in the container 104 or 106, the user may stack the closed container 104 or 106 on the lid 200 of the closed container 100. Since the respective attachment mechanisms mutually engage as described above, the user may easily carry both containers in one hand without fear of the top container sliding off of the bottom container.

While the invention has been described in conjunction with the specific embodiments described above, many equivalent alternatives, modifications and variations may become apparent to those skilled in the art once given this disclosure. Accordingly, the exemplary embodiments of the invention as set forth above are considered to be illustrative and not limiting. Various changes to the described embodiments may be made without departing from the spirit and scope of the invention.

What is claimed is:

1. A container and lid combination, comprising:

a container including:

a bottom surface, an opening, a top edge surrounding the opening, and a first attachment mechanism comprising a plurality of first attachment projections provided on the bottom surface, the first attachment projections having respective first engagement surfaces that each form an acute angle with respect to the bottom surface, each first attachment projection comprising a proximal end attached to the bottom surface, a distal end opposite the proximal end, an outer side surface, an inner side surface opposite the outer side surface, and two end surfaces connecting the inner side surface and the outer side surface, the end surfaces of each first attachment projection being spaced from the end surfaces of adjacent first attachment projections; and a lid engageable with the top edge of the container to cover the opening, the lid including:

an inside surface that faces an interior of the container when the lid is engaged with the top edge of the container, an outside surface that faces away from the interior of the container when the lid is engaged with the top edge of the container, a second attachment mechanism provided on the inside surface and engageable with the first attachment mechanism, the lid being attachable to the bottom surface of the container in a nested state via engagement of the first and second attachment mechanisms, and a third attachment mechanism provided on the outside surface and engageable with the first attachment mechanism, the third attachment mechanism comprising an inner set of inner attachment projections and an outer set of outer attachment projections, the inner attachment projections and the outer attachment projections having respective third engagement surfaces that each form an acute angle with respect to the outside surface, each third attachment projection comprising a proximal end attached to the outside surface, a distal end opposite the proximal end, an outer side surface, an inner side surface opposite the outer side surface, and two end surfaces connecting the inner side surface and the outer side surface, the end surfaces of each third attachment projection being spaced from the end surfaces of adjacent third attachment projections, wherein the lid is attachable to the bottom surface of the container in an inverted state via engagement of the each first attachment projection with a respective one of the and third attachment projections.

2. The container and lid combination according to claim 1, wherein the second attachment mechanism comprises a plurality of second attachment projections protruding from the inside surface of the lid, the second attachment projections having respective second engagement surfaces that each form an acute angle with respect to the inside surface and engage with the first engagement surfaces.

3. The container and lid combination according to claim 1, wherein at least one portion of the container is transparent.

4. The container and lid combination according to claim 1, wherein, as seen in plan view, an outermost circumference of the lid is free of any protrusions.

5. The container and lid combination according to claim 4, wherein the container further comprises a ridge provided around an outer periphery of the container near a top edge of the container, one or more notches being provided in the ridge to facilitate a user's access to the lid when the user removes the lid from the container.

6. A nesting container and lid set comprising:

a plurality of containers, the containers being of different sizes and thereby nestable together, at least two of the containers each including:

a bottom surface, an opening, a top edge surrounding the opening, and a container attachment mechanism provided on the bottom surface, the container attachment mechanism comprising a plurality of first attachment projections provided on the bottom surface, the first attachment projections having respective first engagement surfaces that each form an acute angle with respect to the bottom surface, each first attachment projection comprising a proximal end attached to the bottom surface, a distal end opposite the proximal end, an outer side surface, an inner side surface opposite the outer side surface, and two end surfaces connecting the inner side surface and the outer side surface, the end surfaces of each first attachment projection being spaced from the end surfaces of adjacent first attachment projections; and a corresponding plurality of lids engageable with the top edges of the containers to cover the openings, at least one of the lids including:

an inside surface that faces an interior of the container when the lid is engaged with the top edge of the container, an outside surface that faces away from the interior of the container when the lid is engaged with the top edge of the container, and an outside surface attachment mechanism provided on the outside surface and engageable with the container attachment mechanism of the at least one of the containers, the outside surface attachment mechanism comprising an inner set of attachment projections and an outer set of attachment projections, the inner attachment projections and the outer attachment projections having respective second engagement surfaces that each form an acute angle with respect to the outside surface, each second attachment projection comprising a proximal end attached to the outside surface, a distal end opposite the proximal end, an outer side surface, an inner side surface opposite the outer side surface, and two end surfaces connecting the inner side surface and the outer side surface, the end surfaces of each second attachment projection being spaced from the end surfaces of adjacent second attachment projections;

wherein the bottom surface of a smaller one of the at least two of the containers is attachable to the outside surface of the at least one of the lids via engagement of the first engagement surfaces with the second engagement surfaces of the inner set of attachment projections, but is not attachable via engagement of the first engagement surfaces and the second engagement surfaces of the outer set of attachment projections, and a larger one of the at least two of the containers is attachable to the outside surface of the at least one of the lids via engagement of the first engagement surfaces with the second engagement surfaces of the outer set of attachment projections.

7. The nesting container and lid set according to claim 6, wherein at least one of the lids further comprises an inside surface attachment mechanism provided on the inside surface and engageable with the container attachment mechanism, the lid being attachable to the bottom surface of the corresponding container in a nested state via engagement of the container and inside surface attachment mechanisms.

8. The nesting container and lid set according to claim 6, wherein, in a nested state of the containers and lids, a smaller one of the containers is nested inside a larger one of the containers and a lid corresponding to the smaller container is attached to the bottom surface of the smaller container.

9. The nesting container and lid set according to claim 6, wherein at least one portion of each container is transparent.

10. The nesting container and lid set according to claim 6, wherein, as seen in plan view, an outermost circumference of a lid corresponding to a smaller one of the containers is free of any protrusions.

11. The nesting container and lid set according to claim 10, wherein the smaller container further comprises a ridge provided around an outer periphery of the container near a top edge of the smaller container, one or more notches being provided in the ridge to facilitate a user's access to the lid when the user removes the lid from the container.

12. The nesting container and lid set according to claim 7, wherein the inside surface attachment mechanism comprises a plurality of third attachment projections protruding from the inside surface of the lid, the third attachment projections having respective third engagement surfaces that each form an acute angle with respect to the inside surface and engage with the first engagement surfaces.

13. A container and lid combination, comprising:

a container including:

a bottom surface, an opening, a top edge surrounding the opening, and a first attachment mechanism comprising a plurality of first attachment projections provided on the bottom surface, the first attachment projections having respective first engagement surfaces that each form an acute angle with respect to the bottom surface; and a lid engageable with the top edge of the container to cover the opening, the lid including:

an inside surface that faces an interior of the container when the lid is engaged with the top edge of the container, an outside surface that faces away from the interior of the container when the lid is engaged with the top edge of the container, a second attachment mechanism provided on the inside surface and engageable with the first attachment mechanism, the lid being attachable to the bottom surface of the container in a nested state via engagement of the first and second attachment mechanisms, the second attachment mechanism comprising a plurality of second attachment projections protruding from the inside surface of the lid, the second attachment projections having respective second engagement surfaces that each form an acute angle with respect to the inside surface and engage with the first engagement surfaces, and a third attachment mechanism provided on the outside surface and engageable with the first attachment mechanism, the third attachment mechanism comprising an inner set of inner attachment projections and an outer set of outer attachment projections, the inner attachment projections and the outer attachment projections having respective third engagement surfaces that each form an acute angle with respect to the outside surface, wherein the lid is attachable to the bottom surface of the container in an inverted state via engagement of the each first attachment projection with a respective one of the third attachment projections.

14. The container and lid combination of claim 13, wherein the attachment projections of the first and second attachment mechanisms each comprises an inner set of inner attachment projections and an outer set of outer attachment projections.

* * * * *